United States Patent [19]

Sanders et al.

[11] 4,174,580

[45] Nov. 20, 1979

[54] ADJUSTABLE INDICATING DEVICE

[75] Inventors: Carlos L. Sanders, Atlanta; James L. Gebhardt, Roswell, both of Ga.

[73] Assignee: The Mead Corporation, Dayton, Ohio

[21] Appl. No.: 899,463

[22] Filed: Apr. 24, 1978

[51] Int. Cl.[2] ..... G09F 11/21

[52] U.S. Cl. ..... 40/518; 40/16.4; 40/610; 248/235

[58] Field of Search ..... 40/5, 10 R, 16, 16.2, 40/16.4, 16.6, 19.5, 489, 490, 491, 518, 609, 610, 618; 248/221.4, 235, 300, 309

[56] References Cited

U.S. PATENT DOCUMENTS

| | | | |
|---|---|---|---|
| 2,121,390 | 6/1938 | Roland | 40/489 |
| 2,787,068 | 4/1957 | Anspach | 40/16.4 |
| 3,014,294 | 12/1961 | Singer | 40/518 X |
| 3,016,638 | 1/1962 | Singer | 40/518 X |
| 3,084,463 | 4/1963 | Guyer et al. | 40/16.4 |
| 3,159,937 | 12/1964 | Barnes | 40/518 X |

*Primary Examiner*—John F. Pitrelli
*Assistant Examiner*—G. Lee Skillington
*Attorney, Agent, or Firm*—Walter M. Rodgers; Walter A. Rodgers

[57] ABSTRACT

An adjustable indicating device such as a pricing unit adapted for removable mounting in price channels (12,12*a*) secured to the edges of supermarket shelves (S1,S2) includes a base element (1) formed of semirigid yieldable material and having a medial strut (6) which is bifurcated along one edge to form yieldable supports (7*a*,7*b*) for a pair of mounting strips (8,9) arranged for removable mounting on price channel (12,12*a*), a support channel (14) having a central web section (15) and outwardly protruding flange panels (16,17) is integrally formed along an edge of said medial strut (6) remote from the bifurcated portion thereof and serves as mounting means for one or more elongated plate means (2,3) arranged to position the edges of self-coiling indicia bearing tapes (4) in such manner that the coiled ends (4*a*,4*b*) thereof are disposed behind the support channel (14), a pair of cover mounting reinforcing strips (30,31) formed integrally with the medial strut (16) and extending from opposite sides thereof between the support channel (–) and the bifurcated end (7) of the medial strut (6) and which are respectively provided with longitudinal grooves (32,33) for receiving the edges of the side flanges (28,29) of a removable elongated channel shaped, transparent cover (5) having a central web strip (27) and a pair of side flange strips (28,29) so that indicia on the tapes (4) is observable through the elongated cover (5).

15 Claims, 5 Drawing Figures

ADJUSTABLE INDICATING DEVICE

Article pricing devices which are arranged for removable mounting on conventional price channels secured to the edges of shelves in supermarkets and other similar retail outlets are known. Such known devices frequently are subject to tampering by customers or by vandals due to the fact that the adjustable media such as self coiling tapes on which pricing indicia are formed are readily accessible and may be changed by a simple finger touch. Other known devices of this general character are subject to unauthorized price changing because access to the tapes bearing the price indicia from the rear is simple and may be effected following partial or complete removal of the removable pricing device from the price channel on the shelf edge. Furthermore known pricing devices of the general type to which this invention relates usually are formed of many parts which require complicated assembly procedures and which necessitate the use of tools.

This invention utilizes relatively inexpensive and easy to fabricate extrusions which afford a substantial measure of protection against unauthorized tampering and vandalism but without rendering the changeable parts of the device unduly inaccessible so that authorized changes may be made efficiently by a knowledgable person familiar with the structure and procedure required for changing price and other displayed data.

The invention in one form comprises an elongated base element formed of semirigid, yieldable material having an elongated medial strut bifurcated along one edge to form yieldable supports for a pair of integral mounting strips adapted for removable mounting between the holding strips of a shelf edge price channel, a support channel having a central web section integrally formed along an edge of the medial strut remote from the mounting strips and defining a pair of storage cavities on opposite sides of the medial strut, at least one self coiling tape having its coiled ends disposed respectively in said cavities and having its intermediate section disposed outwardly of said support channel and maintained in flat condition by one or more tape positioning means mounted in the support channel together with a separate elongated cover formed of transparent material arranged to envelope the tapes bearing price and other indicia and disjointably mounted in longitudinal grooves formed in cover supporting reinforcing strips projecting from and formed integrally with said medial strut and disposed between the channel and the mounting strips.

Figure 1:
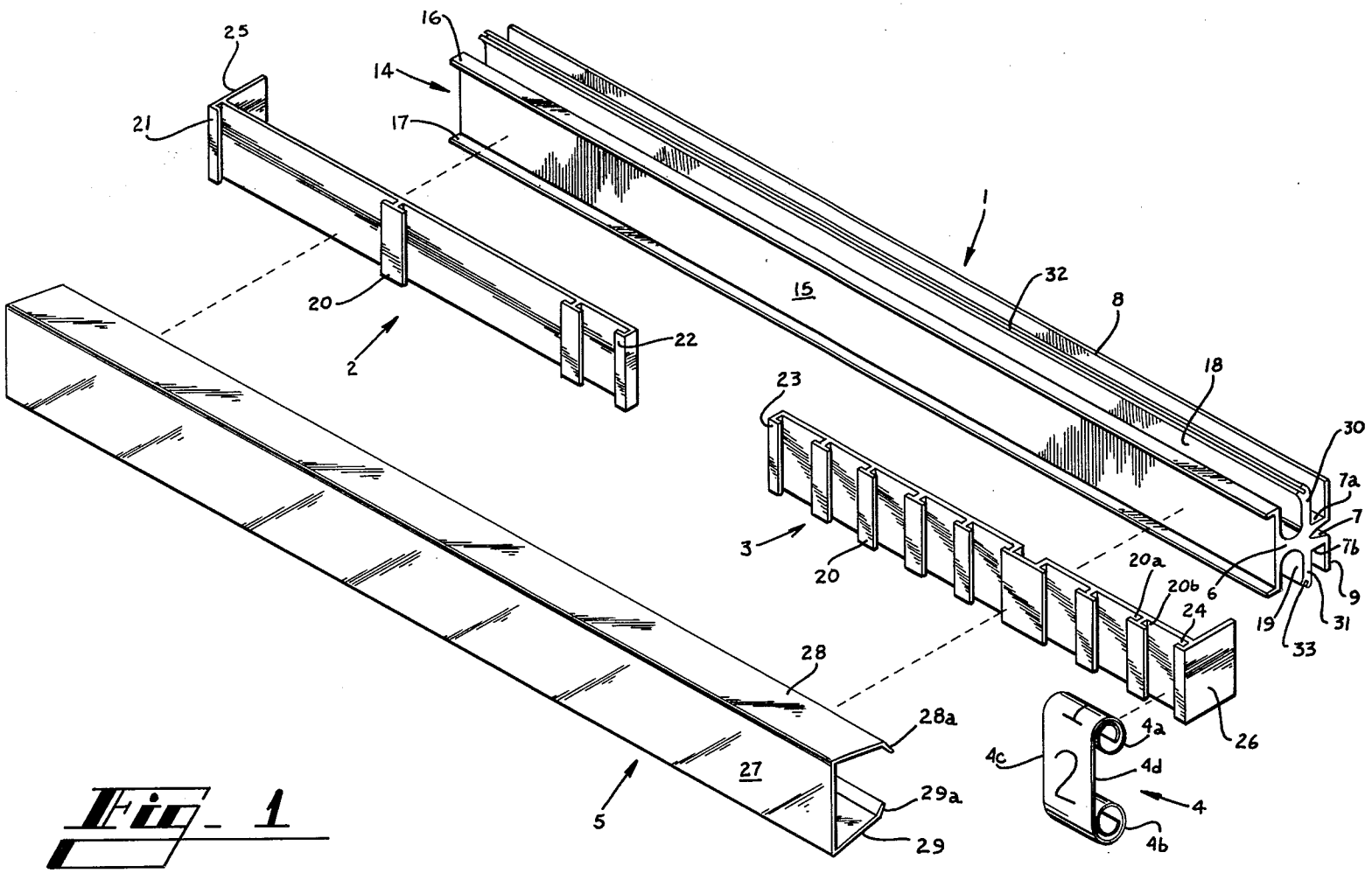
Figure 2:
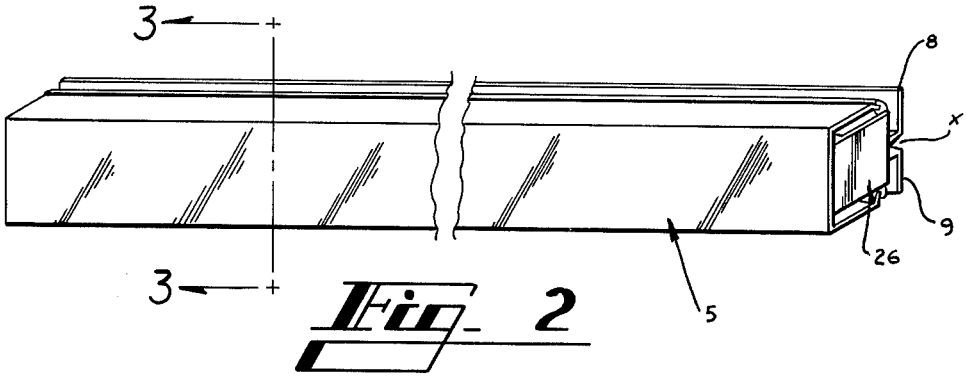
Figure 3:
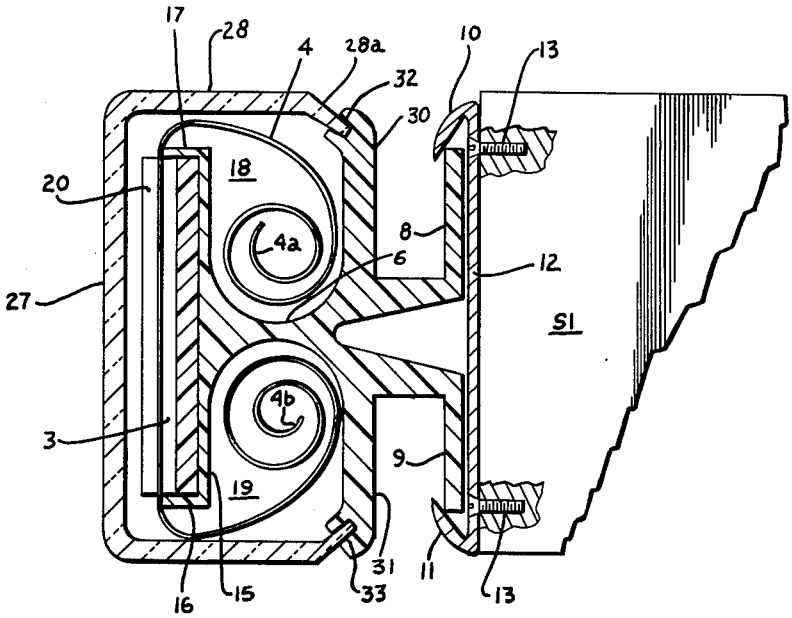
Figure 3A:
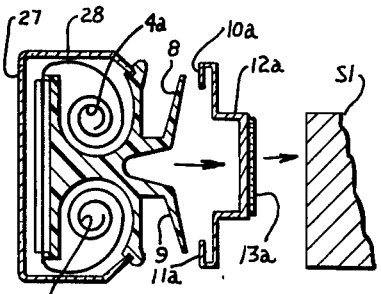
Figure 4:
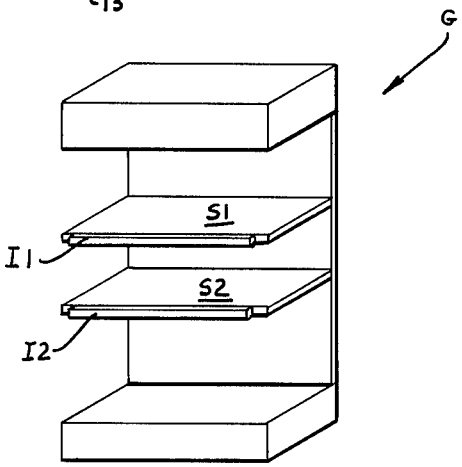

For a better understanding of the invention reference may be had to the following detailed description taken in conjunction with the accompanying drawings in which FIG. 1 is an exploded view of the parts which comprise the invention in one form; FIG. 2 is an isometric view in assembled condition of the parts shown in FIG. 1; FIG. 3 is a cross sectional view taken along the line designated 3—3 in FIG. 2; FIG. 3A is a view similar to FIG. 3 but which depicts a special adapter for use on shelves not having price channels; and in which FIG. 4 is an isometric view of supermarket shelving showing the mounting of adjustable price indicating devices on the price channels of the shelf edges.

In the drawings the numeral 1 generally designates an elongated base element constituting an essential feature of the invention while the numerals 2 and 3 generally designate elongated plate means which serve to position a plurality of self coiling tapes such as that indicated generally by the numeral 4. The numeral 5 generally designates an elongated transparent cover which serves to envelope and protect the elongated plate means and the self coiling tapes when the device is assembled. The cover being formed of transparent material affords a view of the displayed tape indicia and also provides a substantial measure of protection against tampering with the displayed indicia without rendering the tapes inaccessible for authorized indicia changes by one familiar with the procedure for changing the displayed indicia.

The elongated base element 1 includes a medial strut 6 which is bifurcated along one edge as indicated by the numeral 7. This bifurcation provides a pair of yieldable supports 7*a* and 7*b* to the ends of which a pair of integral mounting strips 8 and 9 are integrally formed. These mounting strips 8 and 9 of indicating devices I1 and I2 are manually pressed toward each other and then inserted between the horizontal holding strips 10 and 11 which are integrally formed with the price channel base 12 secured to shelves S1 and S2 on gondola G by screws 13 as best shown in FIG. 3.

For mounting the indicating device on a shelf edge not having a price channel, the device 12*a* shown in FIG. 3A may be used. This device is secured by glue indicated schematically at 13*a* to shelf S1 for example. The mounting strips 8 and 9 are simply pressed toward each other and then inserted between holding strips 10*a* and 11*a*.

For supporting the self coiling tapes on which the displayed indicia is imprinted, a support channel generally designated by the numeral 14 forms an integral part of elongated base element 1 and comprises a central web section 15 and a pair of flange panels 16 and 17. Central web section 15 of support channel 14 defines a pair of storage cavities designated by the numerals 18 and 19 in which the coiled ends 4*a* and 4*b* of a self coiling tape may be stored as is well known in the art as shown in FIG. 3.

For holding the displayed portion of the tapes intermediate their coiled ends in flat condition, the elongated plate means 2 and 3 are provided with tape positioning T-shaped elements 20 which are arranged in known manner so that the side edges 4*c* and 4*d* of the self coiling tapes such as that indicated at 4 may underlie the laterally disposed positioning flanges such as 20*a* and 20*b*. At the ends of plate means 2 a pair of tape positioning flanges 21 and 22 are formed while similar flanges 23 and 24 are formed at the ends of elongated plate means 3. As is apparent from FIGS. 1, 2 and 3, the plate means 2 and 3 are simply mounted between the flange panels 16 and 17 in flat face contacting relation to the central web section 15 and the self coiling tapes are mounted with their coiled ends disposed within storage cavities 18 and 19 and with their side edges intermediate the coiled ends disposed, for example, underneath positioning flange 20*b* and flange 24. In similar fashion as is obvious, self coiling tapes may be disposed throughout the length of the device in association with the positioning means shown in FIG. 1.

While the elongated plate means 2 and 3 as shown in FIG. 1 is in the form of two plates, it will be understood that by certain obvious modifications of the invention, a single elongated plate means could be used or more than two plates could be employed if desired.

For the purpose of affording a measure of security against undesired tampering, a closure plate 25 is formed on the outer end of elongated plate means 2 while a similar closure plate 26 is integrally formed on the outer end of elongated plate means 3. These closure means 25 and 26 secure the ends of the device as is apparent from FIG. 2. In order to change indicia on self coiling tapes such as that indicated at 4, it is simply necessary to apply finger pressure to the flat portion of the tape which is disposed against the elongated plate means such as those indicated at 2 and 3 and to apply a force thereto in the desired direction. Thus as is well known, the indicia displayed can be readily changed.

For the purpose of affording substantial protection against vandalism and unauthorized tampering with the displayed indicia, an elongated cover generally designated by the numeral 5 is arranged to envelope the pricing structure. Such cover includes a central web strip 27 and a pair of side flange strips 28 and 29.

For mounting the elongated cover, a pair of cover mounting reinforcing strips 30 and 31 are integrally formed with medial strut 6 and are provided with longitudinal grooves 32 and 33 respectively. In order to mount the elongated cover 5 in assembled position as shown in FIG. 2, the cover is manipulated so that the edges 28*a* and 29*a* of side flange strips 28 and 29 are inserted into longitudinal grooves 32 and 33 respectively and the assembled structure appears as shown in FIG. 2.

From the above description, it is apparent that all of the structural components of the invention such as the elongated base element 1, the elongated plate means 2 and 3 as well as the elongated cover 5 may be extrusions and as such are readily and economically formed of semirigid yieldable mechanically sturdy material. The invention thus facilitates changing of displayed indicia by a knowledgable operator familiar with the structure and function of the parts and also affords substantial protection against vandalism and undesired tampering.

The embodiments of the invention in which an exclusive property or privilege is claimed are defined as follows:

We claim:

1. An adjustable indicating device arranged for mounting on a shelf edge moulding strip having a pair of vertically spaced horizontal holding strips, said device comprising an elongated base element formed of semirigid yieldable material and having an extruded elongated medial strut coextensive with said base element and bifurcated along one edge to form yieldable supports for a pair of integral mounting strips adapted for removable mounting between said holding strips and respectively engageable therewith so as to support said elongated base element, a support channel having a central web section integrally formed along an edge of said medial strut remote from said mounting strips and defining a pair of storage cavities on opposite sides of said medial strut, at least one self coiling tape having its coiled ends disposed respectively in said cavities and having its intermediate section disposed outwardly of said support channel and being movable vertically relative thereto, and visually observable indicia formed along the length of said tape.

2. An adjustable indicating device arranged for mounting on a shelf edge moulding strip having a pair of vertically spaced horizontal holding strips, said device comprising an elongated base element formed of semirigid yieldable material and having an elongated medial strut bifurcated along one edge to form yieldable supports for a pair of integral mounting strips adapted for removable mounting between said holding strips and respectively engageable therewith so as to support said elongated base element, a support channel having a pair of spaced apart outwardly peotruding flange panels and a central web section integrally formed along an edge of said medial strut remote from said mounting strips and defining a pair of storage cavities on opposite sides of said medial strut, elongated plate means disposed between said flange panels, tape positioning means formed on said plate means for engaging the side edges of said tape in overlapping relation, at least one self coiling tape having its coiled ends disposed respectively in said cavities and having its intermediate section disposed outwardly of said support channel and being movable vertically relative thereto, and visually observable indicia formed along the length of said tape.

3. A device according to claim 2 wherein said tape positioning means comprises at least one pair of positioning ribs transversely spaced along the length of said elongated plate means the outer edges of which are arranged to extend laterally in overlapping relation with the side edges of said tape.

4. A device according to claim 2 wherein a plurality of elongated plates are interposed between said flange panels and wherein tape positioning means is formed on each of said elongated plates.

5. A device according to claim 2 wherein a pair of end closure panels are formed integrally with said plate means and disposed at the ends of said elongated base element.

6. An adjustable indicating device arranged for mounting on a shelf edge moulding strip having a pair of vertically spaced horizontal holding strips, said device comprising an elongated base element formed of semirigid yieldable material and having an elongated medial strut bifurcated along one edge to form yieldable supports for a pair of integral mounting strips adapted for removable mounting between said holding strips and respectively engageable therewith so as to support said elongated base element, a support channel having a central web section integrally formed along an edge of said medial strut remote from said mounting strips and defining a pair of storage cavities on opposite sides of said medial strut, at least one self coiling tape having its coiled ends disposed respectively in said cavities and having its intermediate section disposed outwardly of said support channel and being movable vertically relative thereto, visually observable indicia formed along the length of said tape, and a pair of reinforcing strips formed along opposite sides of said medial strut and intermediate said support channel and said mounting strips.

7. A device according to claim 6 wherein a longitudinal groove is formed along the outer edge of each of said reinforcing strips.

8. A device according to claim 7 wherein an elongated cover of semirigid transparent material and having a central web strip and a pair of side flange strips is arranged with the outer edges of said flange strips removably disposed in said grooves respectively.

9. An adjustable indiating device arranged for removable mounting on a shelf edge moulding strip, said device comprising an elongated base element having a medial strut, mounting strip means formed along an edge of said strut and engageable with said shelf moulding strip for removably securing said elongated base element thereto, a support channel having a web section and a pair of flange panels and being formed medially thereof along the opposite edge of said strut and disposed in substantially normal relation thereto with its flange panels protruding outwardly and defining a pair of storage cavities on opposite sides of said medial strut, elongated plate means mounted on said channel and disposed between said flange panels, at least two transversely spaced outwardly protruding ribs formed on said plate means and having laterally extending positioning flanges, a self coiling tape mounted on said elongated plate means with its edges underneath said positioning flanges and with its coiled ends disposed in said storage cavities, a pair of cover mounting reinforcing strips formed along opposite sides of said medial strut and intermediate said mounting strip means and said channel, longitudinal grooves formed in the edges of said reinforcing strip respectively and an elongated cover having a central web strip and a pair of side flange strips formed of transparent material of generally U-shaped cross section and disposed in enveloping relation to said support channel, said elongated plate means and said self coiling tape, the edges of said side flange strips being removably mounted in said longitudinal grooves in said cover mounting ribs respectively.

10. An indicating device according to claim 9 wherein said shelf edge moulding strip is secured to the shelf edge by adhesive means.

11. An adjustable indicating device arranged for mounting on a shelf edge, said device comprising an elongated base element having a medial strut, a support channel having a web section and a pair of flange panels and being formed medially thereof along the opposite edge of said strut and disposed in substantially normal relation thereto with its flange panels protruding outwardly and defining a pair of storage cavities on opposite sides of said medial strut, elongated plate means mounted on said channel and disposed between said flange panels, at least two transversely spaced outwardly protruding ribs formed on said plate means and having laterally extending positioning flanges, a self coiling tape mounted on said elongated plate means with its edges underneath said positioning flanges and with its coiled ends disposed in said storage cavities, a pair of cover mounting reinforcing strips formed along opposite sides of said medial strut and said channel, longitudinal grooves formed in the edges of said reinforcing strip respectively, and an elongated cover having a central web strip and a pair of side flange strips formed of transparent material of generally U-shaped cross section and disposed in enveloping relation to said support channel, said elongated plate means and said self coiling tape, the edges of said side flange strips being removably mounted in said longitudinal grooves in said cover mounting ribs respectively.

12. In an adjustable indicating device assembly, an integrally formed elongated base element of semirigid material and comprising an extruded elongated medial strut coextensive with said base element and bifurcated along one edge to form a pair of semirigid mounting strips, a support channel having a central web strip formed along an edge of said medial strut remote from said mounting strips and defining a pair of storage cavities on opposite sides of said medial strut.

13. In an adjustable indicating device assembly, an integrally formed elongated base element of semirigid material and comprising an elongated medial strut bifurcated along one edge to form a pair of semirigid mounting strips, a support channel having a central web strip formed along an edge of said medial strut remote from said mounting strips and defining a pair of storage cavities on opposite sides of said medial strut, said central web strip being disposed in substantially normal relation to said medial strut, and a pair of outwardly protruding side flange strips formed along the edges of said central web strip of said support channel.

14. In an adjustable indicating device assembly, an integrally formed elongated base element of semirigid material and comprising an elongated medial strut bifurcated along one edge to form a pair of semirigid mounting strips, a support channel having a central web strip formed along an edge of said medial strut remote from said mounting strips and defining a pair of storage cavities on opposite sides of said medial strut, and a pair of reinforcing strips formed along opposite sides of said medial strut and intermediate said mounting strips and said support channel.

15. A base element according to claim 14 wherein a longitudinal groove is formed along the outer edge of each of said reinforcing strips.

* * * * *